US011654477B2

(12) United States Patent
Lee et al.

(10) Patent No.: US 11,654,477 B2
(45) Date of Patent: May 23, 2023

(54) METHOD FOR MANUFACTURING ALUMINUM ALLOY EXTERIOR MATERIAL FOR SMART DEVICE

(71) Applicant: KOREA INSTITUTE OF MACHINERY & MATERIALS, Daejeon (KR)

(72) Inventors: Yun Soo Lee, Changwon-si (KR); Hyoung Wook Kim, Changwon-si (KR); Su Hyeon Kim, Changwon-si (KR); Kwang Jun Euh, Changwon-si (KR)

(73) Assignee: KOREA INSTITUTE OF MATERIALS SCIENCE, Changwon-si (KR)

( * ) Notice: Subject to any disclaimer, the term of this patent is extended or adjusted under 35 U.S.C. 154(b) by 300 days.

(21) Appl. No.: 16/672,419

(22) Filed: Nov. 1, 2019

(65) Prior Publication Data

US 2021/0016344 A1 Jan. 21, 2021

(30) Foreign Application Priority Data

Jul. 16, 2019 (KR) ..... 10-2019-0085588

(51) Int. Cl.
*B22D 11/00* (2006.01)
*B22D 11/04* (2006.01)
(Continued)

(52) U.S. Cl.
CPC ..... *B22D 11/003* (2013.01); *B22D 11/008* (2013.01); *B22D 11/0405* (2013.01);
(Continued)

(58) Field of Classification Search
CPC ..... B22D 11/00; B22D 11/003; B22D 11/008; B22D 11/04; B22D 11/0405; B22D 11/06; B22D 11/0622; C25D 11/04
(Continued)

(56) References Cited

U.S. PATENT DOCUMENTS

2013/0065181 A1* 3/2013 Sawada et al. ..... B41N 1/083 205/661

FOREIGN PATENT DOCUMENTS

KR 10-1118740 B1 3/2012
KR 10-2014-0132002 A 11/2014
(Continued)

OTHER PUBLICATIONS

Korean Office Action dated Sep. 21, 2020, in connection with the Korean Patent Application No. 10-2019-0085588.

*Primary Examiner* — Kevin P Kerns
(74) *Attorney, Agent, or Firm* — Hauptman Ham, LLP

(57) ABSTRACT

Provided is a method for manufacturing an aluminum alloy exterior material for smart devices which is formed not by extrusion or die casting but by a strip casting method using a rotating mold, and an aluminum alloy exterior material manufactured by the method. In accordance with an embodiment, the method includes: preparing a molten aluminum alloy; casting the molten aluminum alloy into a sheet shape using a rotating mold to form an aluminum alloy cast sheet; and anodizing the aluminum alloy cast sheet, wherein in the forming of an aluminum alloy cast sheet, X in Equation 1 below may have a value in the range of greater than 0 and equal to or less than 0.15.

$$X=(W_{Zn}+W_{Mg}+W_{Cu}+W_{Si})/TC \quad \text{<Equation 1>}$$

(Continued)

Here, $W_{Zn}+W_{Mg}+W_{Cu}+W_{Si}$ is the total content (wt %) of zinc, magnesium, copper and silicon) in the aluminum alloy, and TC is the thermal conductivity (W/m·K) of the rotating mold.

7 Claims, 15 Drawing Sheets

(51) Int. Cl.
*B22D 11/06* (2006.01)
*C25D 11/04* (2006.01)
*C22F 1/053* (2006.01)
*C22C 21/10* (2006.01)

(52) U.S. Cl.
CPC ..... *B22D 11/06* (2013.01); *C22C 21/10* (2013.01); *C22F 1/053* (2013.01); *C25D 11/04* (2013.01)

(58) Field of Classification Search
USPC ..... 164/477, 480, 428; 148/549
See application file for complete search history.

(56) References Cited

FOREIGN PATENT DOCUMENTS

| | | | |
|---|---|---|---|
| KR | 10-2016-0036297 | A | 4/2016 |
| KR | 10-1685926 | B1 | 12/2016 |
| KR | 10-2018-0025955 | A | 3/2018 |

* cited by examiner

METHOD FOR MANUFACTURING ALUMINUM ALLOY EXTERIOR MATERIAL FOR SMART DEVICE

CROSS-REFERENCE TO RELATED APPLICATION

This application claims priority to Korean Patent Application No. 10-2019-0085588 filed on Jul. 16, 2019 and all the benefits accruing therefrom under 35 U.S.C. § 119, the contents of which are incorporated by reference in their entirety.

BACKGROUND

The present disclosure relates to a method for manufacturing an aluminum alloy casting material for smart devices, and more particularly, to a method for manufacturing an aluminum alloy casting material available as exterior materials for smart devices.

Recently, in order to satisfy user's demand putting emphasis on design and durability, a metal exterior material tends to be used for various electronic devices such as smartphones, tablets, laptop computers, smart watches, electronic book readers.

Aluminum alloys have been used as such an exterior material for smart devices. In order to manufacture an exterior material using an aluminum alloy, a method has been used in which a casting material is extruded to manufacture an aluminum base material, the base material is processed into a final shape by using a numerical control machine tool, and then the surface of the final shape is anodized to achieve high-grade colors and textures. In general, the aluminum base material is manufactured by performing, with respect to a continuously cast billet, homogenization heat-treatment, extrusion, aging treatment, and the like, and then performing cutting such as CNC machining and anodizing for application to an exterior material for electronic devices.

However, in case of an aluminum exterior material manufacturing process based on a conventional extrusion process, there is a limitation of much energy consumption because a cast billet should be reheated to perform homogenization heat-treatment, and then reheated to perform hot extrusion. In addition, in case of 6000 series alloys or 7000 series alloys, which are high-strength aluminum alloys, there is a limitation of high initial equipment cost due to a high extrusion load. Furthermore, since dimension accuracy of cutting process is degraded due to residual stress caused by differences in amounts of deformation of inside/outside of an extrusion material during extrusion, rough machining is required, and this causes a rise in costs.

Meanwhile, in another manufacturing method, such as an aluminum exterior material manufacturing process based on conventional die casting, there is a merit in that casting of the aluminum exterior material is possible similar to the final shape of an exterior material for electronic devices, and a merit of relatively lower equipment costs and energy consumption than an extrusion process, but there is a limitation of a high defect rate due to generation of pores in the surface and the inside of the material and soldering between the material and a mold. In addition, in general, silicon (Si) which is added by a great amount in order to enhance fluidity of molten metal during aluminum alloy die casting has a limitation of disturbing the formation of uniform and superior anodized surface by an oxidization reaction or the like during anodizing treatment. In addition, in general, the die casting aluminum alloy series has a disadvantage of having lower strength than a wrought aluminum alloy.

PRIOR ART DOCUMENT

Patent Document (Patent document 1) Korean Patent Application No. 10-2015-0100890

SUMMARY

The present disclosure provides a method for manufacturing an aluminum alloy exterior material for smart devices which is not formed by extrusion or die casting, but is formed by a strip casting method using a rotating mold, and an aluminum alloy exterior material for smart devices manufactured by the method.

However, the above purposes are merely illustrative, and the scope of the present invention is not limited thereto.

In accordance with an embodiment, there is provided a method for manufacturing an aluminum alloy exterior material for smart devices using a rotating mold.

In accordance with an embodiment, the method includes: preparing a molten aluminum alloy; casting the molten aluminum alloy into a sheet shape using a rotating mold to form an aluminum alloy cast sheet; and anodizing the aluminum alloy cast sheet, wherein in the forming of the aluminum alloy cast sheet, X in Equation 1 below has a value in the range of greater than 0 to equal to or less than 0.15.

$$X=(W_{Zn}+W_{Mg}+W_{Cu}+W_{Si})/\mathrm{TC} \qquad \text{<Equation 1>}$$

Here, $W_{Zn}+W_{Mg}+W_{Cu}+W_{Si}$ is the total content (wt %) of zinc (Zn), magnesium (Mg), copper (Cu) and silicon (Si)) in the aluminum alloy, and TC is the thermal conductivity (W/m·K) of the rotating mold.

In an embodiment, the method may further include heat-treating the aluminum alloy cast sheet after performing forming of the aluminum alloy cast sheet.

In an embodiment, the heat-treating may include performing a solution treatment for 30 minutes to 10 hours at a temperature of 420° C. to 570° C.

In an embodiment, the heat-treating may further include, after performing the solution treatment, performing an aging treatment for 1 hour to 30 hours at a temperature of 100° C. to 250° C.

In an embodiment, the method may further include cutting the aluminum alloy cast sheet after performing forming of the aluminum alloy cast sheet.

In an embodiment, the method may further include cold working the aluminum alloy cast sheet before performing the cutting.

In an embodiment, the method may further include hot working the aluminum alloy cast sheet before performing the cutting.

In an embodiment, the hot working may include at least one of hot forging or hot stamping.

In an embodiment, the aluminum alloy cast sheet may include a 6000 series aluminum alloy or a 7000 series aluminum alloy.

In an embodiment, the aluminum alloy cast sheet may include: zinc (Zn) in the range of 5 wt % to 10 wt %; magnesium (Mg) in the range of 1 wt % to 4 wt %; copper (Cu) in the range of greater than 0 wt % to 3 wt %; silicon (Si) in the range of greater than 0 wt % to 0.5 wt %; and the remainder being aluminum and inevitable impurities.

In an embodiment, the aluminum alloy cast sheet may include silicon (Si) in the range of greater than 0 wt % to 1.5 wt %, magnesium (Mg) in the range of greater than 0 wt % to 1.2 wt %, copper (Cu) in the range of greater than 0 wt % to 1 wt %; zinc (Zn) in the range of greater than 0 wt % to 0.5 wt %, and the remainder being aluminum and inevitable impurities.

In an embodiment, the rotating mold may include a copper twin-roll or a steel twin-roll.

In an embodiment, the rotating mold may have thermal conductivity in the range of 200 W/m·K to 500 W/m·K or a range of 20 W/m·K to 50 W/m·K.

In accordance with another embodiment, an aluminum alloy exterior material for a smart device includes: a 6000 series or 7000 series aluminum alloy base material including zinc (Zn), magnesium (Mg), copper (Cu), and silicon (Si) in a total content (wt %) in the range of 1.5 wt % to 15 wt %; and an anodized layer formed on a surface of the base material.

In an embodiment, the aluminum alloy base material may have a cast structure having dendrites formed in cast grains, and the anodized layer may not have a defect caused therein due to an inversely segregated substance including any one or more among zinc, magnesium and copper.

In embodiment, a secondary dendrite arm spacing (SDAS) of the dendrite may have a range of 2 μm to 20 μm.

In an embodiment, the cast grains may have an equiaxed crystal structure.

In an embodiment, the cast grains may have a structure having at least a portion elongated in a specific direction.

In an embodiment, an engraved portion may be formed on at least one surface of the aluminum alloy base material.

BRIEF DESCRIPTION OF THE DRAWINGS

Embodiments can be understood in more detail from the following description taken in conjunction with the accompanying drawings, in which.

DETAILED DESCRIPTION

Figure 1:
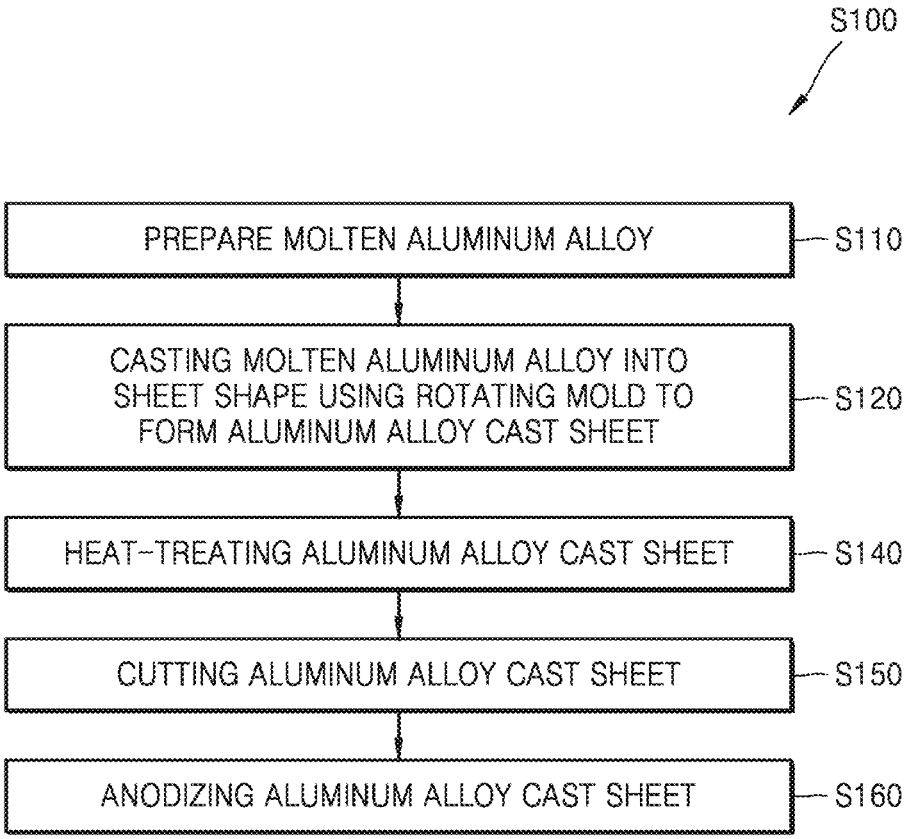
FIG. 1 is a flowchart illustrating a method for manufacturing an aluminum alloy exterior material for smart devices in accordance with an embodiment.

Embodiments of the present invention will be described below in detail with reference to the accompanying drawings. The embodiments of the present invention are provided so that those skilled in the art thoroughly understand the present disclosure, and the following embodiments may be embodied in many different forms and the inventive concept should not be construed as being limited to the embodiments set forth herein. Rather, these embodiments are provided so that this disclosure will be thorough and complete, and will fully convey the scope of the present disclosure to those skilled in the art. In the specification, like reference numerals refer to like elements throughout. Furthermore, various elements and regions in the drawings are schematically drawn. Accordingly, the technical concept of the present invention is not limited by relative sizes or intervals depicted in the accompanying drawings.

In this specification, strip casting is a kind of continuous casting method and refers to a technique of manufacturing a thin slab by directly injecting a molten metal into a mold having a roll or belt shape. Such the strip casting method includes a twin-roll casting method, a twin-belt casting method, and the like.

Figure 16:
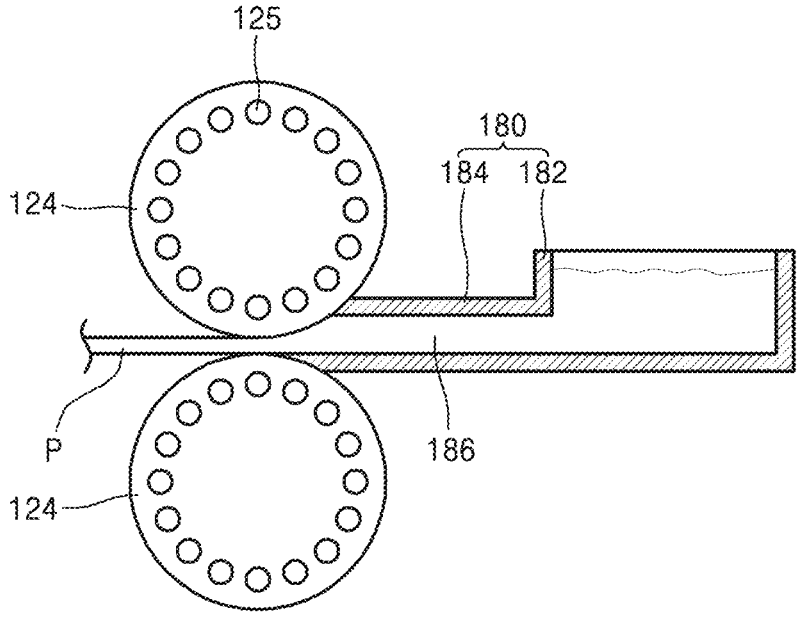
FIG. 16 is a schematic view of a twin-roll casting apparatus exemplified as an example of a strip casting apparatus.

FIG. 16 illustrates a twin-roll casting apparatus as an example of a strip casting apparatus. Referring to FIG. 16, the twin-roll casting apparatus is configured by including: a pair of rotating twin-rolls 124; and a molten metal injection means 180 that injects a molten metal into a separation space between the twin rolls 124. The molten metal injection means 180 includes: a tundish 182 that receives a molten metal from a smelting furnace and temporarily stores the molten metal; a nozzle 184 that guides and injects the molten metal from the tundish 182 into the separation space between the twin rolls 124; and an injection port 186. The molten metal injected into the separation space of the twin rolls 124 receives the effect of being cooled and solidified by the twin rolls and being rolled by the twin rolls 124 and is discharged as a solid sheet P. At this point, cooling water passages 125 are provided inside the rollers constituting the twin rolls 124. The cooling water passages 125 are configurations for absorbing heat of the molten metal, are radially provided in plurality, and are connected to a pump so as to be capable of controlling the flow rate of the cooling water.

In the present invention, one of the important technical concepts is that in order to achieve an aluminum strip having a superior surface characteristic during strip casting, a suitable solidification speed is required, and the solidification speed is mutually linked to the contents of alloy elements included in the aluminum alloy. The alloy elements include zinc (Zn), magnesium (Mg), copper (Cu), silicon (Si), and the like.

The inventors of the present invention found that when inversely segregated substances including alloy elements on the surface of an aluminum alloy sheet strip-casted by using the abovementioned strip casting apparatus, various problems occur in which colors of anodized layer become non-uniform at a portion, in which inversely segregated substances are formed, are not normally formed, or the like. Such a tendency of formation of inversely segregated substances increases as the contents of the alloy elements contained in the aluminum alloy increase, and accordingly, in case of a high-alloy series aluminum alloy such as 7000 series, the degradation of the anodizing characteristics due to such inverse segregation are further seriously exhibited.

The inventors of the present invention found that the solidification speed is required to be quick during strip casting in order to solve the problems due to such inverse segregation, and the more the content of the alloy contained in the aluminum alloy, the quicker the solidification speed should be. In case of strip casting, the solidification speed directly relates to the speed of being cooled through a rotating mold. That is, the higher the thermal conductivity of the material of the rotating mold, the higher the cooling speed, and accordingly, the solidification speed of the molten metal increases. Thus, the inventors of the present invention derived an equation between the contents of alloy elements in the strip cast aluminum alloy and thermal conductivity of the materials of the rotating mold as a condition for suppressing surface inverse segregation (these will be described in detail later), and thus could manufacture an aluminum alloy cast sheet having the same anodizing characteristic as an aluminum alloy sheet using a conventional extrusion material. Accordingly, even in the case of high-strength aluminum alloy corresponding to the 6000 or 7000 series which has a wrought alloy material composition, when strip cast is performed under predetermined conditions, superior anodizing characteristics and superior mechanical characteristics are simultaneously achieved by itself without additional deformation processing, and thus, it is possible to manufacture an exterior material for a smart device more easily and economically than in related arts.

Hereinafter, such a method for implementing the inventive concept of the present invention will be described in detail.

FIG. 1 is a flowchart illustrating a method S100 for manufacturing an aluminum alloy exterior material for smart devices in accordance with an embodiment. The smart devices include various portable electronic devices such as smart phones, tablets, laptop computers, smart watches, and electronic book readers.

Referring to FIG. 1, a method S100 for manufacturing an aluminum alloy exterior material for smart devices includes: preparing a molten aluminum alloy (S110); casting the molten aluminum alloy into a sheet shape using a rotating mold to form an aluminum alloy cast sheet (S120); heat-treating the aluminum alloy cast sheet (S140); cutting the aluminum alloy cast sheet (S150); and anodizing the aluminum alloy cast sheet (S160).

In the forming of the aluminum alloy cast sheet, X in Equation 1 below has a value in the range of greater than 0 and equal to or less than 0.15.

$$X=(W_{Zn}+W_{Mg}+W_{Cu}+W_{Si})/\mathrm{TC} \quad \text{<Equation 1>}$$

Here, $W_{Zn}+W_{Mg}+W_{Cu}+W_{Si}$ is the total sum, expressed in wt %, of the content $W_{Zn}$ of zinc (Zn), the content $W_{Mg}$ of magnesium (Mg), the content $W_{Cu}$ of copper (Cu), and the content $W_{Si}$ of silicon (Si) in the aluminum alloy, and TC is the thermal conductivity (W/m·K) of the rotating mold.

The rotating mold may include a copper twin roll or a steel twin roll. Here, the copper twin roll includes all twin rolls formed of pure copper or copper alloys. Here, the thermal conductivity of copper may have a range of 200 W/m·K to 500 W/m·K. In addition, the thermal conductivity of the steel twin roll may have a range of 20 W/m·K to 50 W/m·K.

The heat-treating S140 may include all heat treatment performed so as to homogenize the internal characteristics of the strip cast aluminum sheet or enhance the mechanical characteristics of the strip cast aluminum sheet. The heat-treating S140 may include a solution treatment and an aging treatment. The solution treatment may be performed for 30 minutes to 10 hours at a temperature of 420° C. to 570° C. After performing the solution treatment, cool water quenching may be performed. The aging treatment may be performed for 1 hour to 30 hours at a temperature of 100° C. to 250° C.

The cutting S150 may be performed to form the shape or structure of the exterior material for smart devices. In particular, the cutting may be performed to realize several structures formed in the exterior material for smart devices, for example, engraved portions, holes, or the like. The cutting may be performed representatively by computer numerical control processing or the like.

The anodizing S160 is a step for forming an anodized layer having a beautiful color on the surface of the strip-cast casting material, and the formed anodized layer may have a range of 1 μm to 100 μm.

In some modified examples of the embodiment, one or more of the heating S140 and the cutting S150 may be omitted according to cases. That is, according to the modified example, the strip-cast aluminum sheet may be directly anodized without heat-treatment or cutting to manufacture a surface-treated aluminum alloy member.

In another modified example of the embodiment, the method may further include cold working the aluminum cast sheet before the cutting S150. The cold working may include cold rolling or cold extrusion. The cold working may selectively be performed for the purpose of improving the strength of the cast sheet through work hardening. For example, improvement in the strength of the cast sheet due to work hardening may be derived by performing cold rolling on the cast sheet which completed the solution treatment and the aging treatment.

Figure 2:
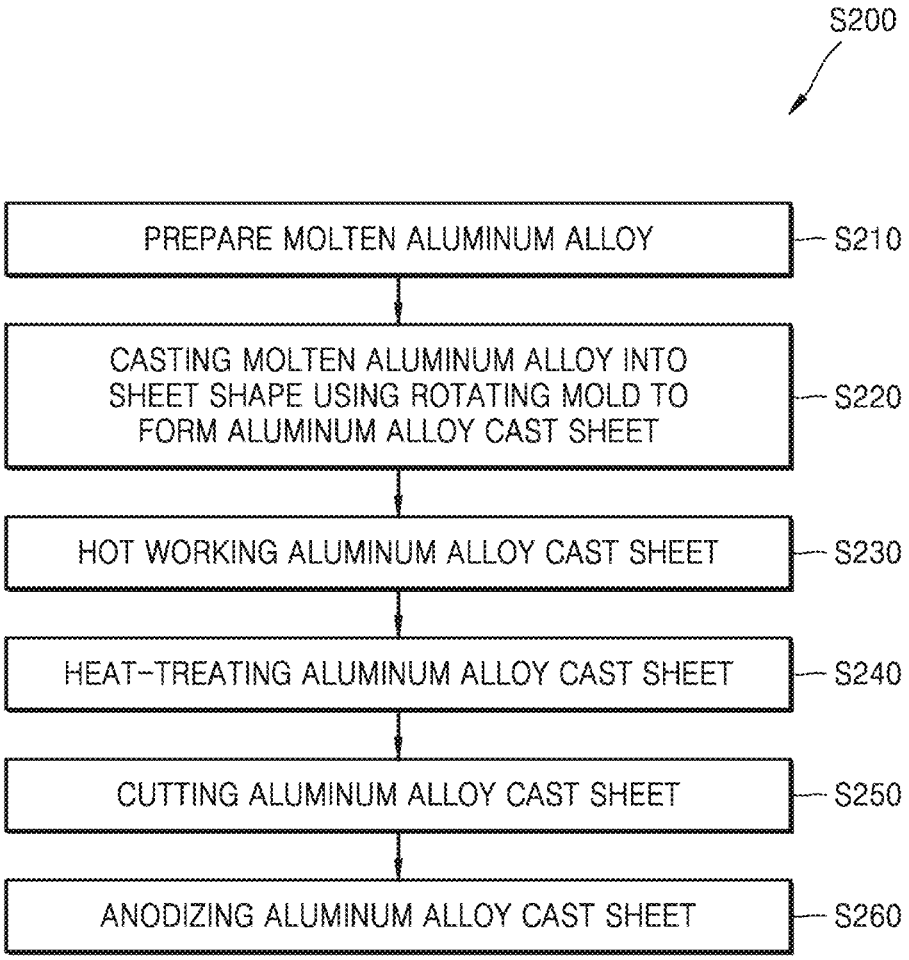
FIG. 2 is a flowchart illustrating a method for manufacturing an aluminum alloy exterior material for smart devices in accordance with an embodiment.

FIG. 2 is a flowchart illustrating a method S200 for manufacturing an aluminum alloy exterior material for smart devices in accordance with another embodiment. For reference, descriptions on components overlapping with the embodiment of FIG. 1 will be omitted.

Referring to FIG. 2, a method S200 for manufacturing an aluminum alloy exterior material for smart devices includes: preparing a molten aluminum alloy (S210); casting the molten aluminum alloy into a sheet shape using a rotating mold to form an aluminum alloy cast sheet (S220); hot working the aluminum alloy cast sheet (S230); heat-treating the aluminum alloy cast sheet (S240); cutting the aluminum alloy cast sheet (S250); and anodizing the aluminum alloy cast sheet (S260).

The hot working S230 is a step for manufacturing the aluminum alloy cast sheet into a shape close to the final exterior material before performing the cutting, and may obtain an effect of reducing a cutting amount during the cutting to reduce scrap generated during the cutting. The hot working may be performed by using any one or more among, for example, hot forging or hot stamping.

The aluminum alloy exterior material for smart devices which is manufactured by using the abovementioned methods includes: a 6000 series or 7000 series aluminum alloy base material including zinc (Zn), magnesium (Mg), copper (Cu), and silicon (Si) in a total content (wt %) in the range of 1.5 wt % to 15 wt %; and an anodized layer formed on a surface of the base material.

The aluminum alloy base material may include a 6000 series aluminum alloy or a 7000 series aluminum alloy. For example, the aluminum alloy base material may include: zinc (Zn) in the range of 5 wt % to 10 wt %; magnesium (Mg) in the range of 1 wt % to 4 wt %; copper (Cu) in the range of greater than 0 wt % to 3 wt %; silicon (Si) in the range of greater than 0 wt % to 0.5 wt %; and the remainder being aluminum and inevitable impurities. In another example, the aluminum alloy cast sheet may include silicon (Si) in the range of greater than 0 wt % to 1.5 wt %, magnesium (Mg) in the range of greater than 0 wt % to 1.2 wt %, copper (Cu) in the range of greater than 0 wt % to 1 wt %; zinc (Zn) in the range of greater than 0 wt % to 0.5 wt %, and the remainder being aluminum and inevitable impurities.

The aluminum alloy base material is a plate-like cast material and has a cast structure in which the microstructure has equiaxed cast grains. At this point, the cast grains include dendrites generated therein in a solidification process. The dendrite may have a secondary dendrite arm spacing (SDAS) in the range of 2 μm to 20 μm, more strictly, in the range of 5 μm to 20 μm according to the solidification speed during casting.

Meanwhile, the aluminum alloy base material may have, when cold working or hot working is performed after casting, a microstructure in which the equiaxed cast grains are at least partially elongated in a specific direction (for example, in case of rolling, the processing direction, and in case of forging, a direction perpendicular to the processing direction).

Figure 3A:
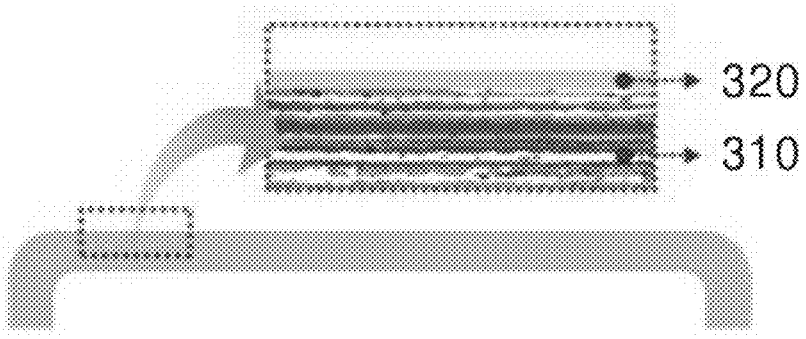
FIGS. 3A to 3C illustrate an internal structure of the aluminum alloy exterior material formed by using a manufacturing method in accordance with a related art and an internal structure of the aluminum alloy exterior material formed by using a method for manufacturing the aluminum alloy exterior material for smart devices in accordance with an embodiment.
Figure 3B:
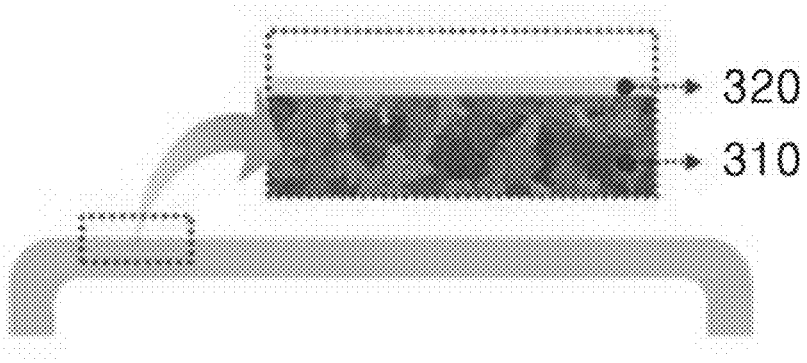
Figure 3C:
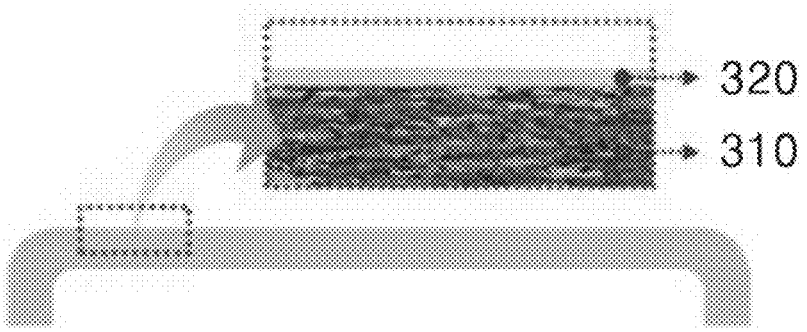

FIGS. 3A to 3C illustrate an internal structure of the aluminum alloy exterior material formed by using a manufacturing method in accordance with a related art and a manufacturing method in accordance with an embodiment. In FIGS. 3A to 3C, reference numeral 310 refers to an aluminum alloy sheet substrate and reference numeral 320 refers to an anodized layer.

Referring to FIG. 3A, an aluminum alloy sheet substrate formed by using a conventional extruding method has a microstructure in which crystal grains are elongated in the extrusion direction.

Referring to FIG. 3B, an aluminum alloy sheet substrate formed by using the manufacturing method S100 of FIG. 1 includes as a cast structure, a microstructure composed of equiaxed cast grains.

Referring to FIG. 3C, an aluminum alloy sheet substrate formed by using the manufacturing method S200 of FIG. 2 includes a microstructure having a cast structure in which cast grains are elongated by hot working, such as hot press working, but has a low degree of elongation and thus exhibits a structure different from the microstructure formed by extrusion in FIG. 3A.

In addition, an inversely segregated substance including any one or more among zinc, magnesium, and copper is not formed on the surface of the aluminum alloy, and accordingly, a defective portion caused by the inversely segregated substance does not appear in an anodized layer and very superior surface characteristics are exhibited.

The inversely segregated substance is defined as a segregated substance formed when high-concentration solute elements accumulated in the tips of the dendrites in a solidification process are pressed during strip casting while passing through a cold roll, and move to a sheet surface via the path, which is the gap between the dendrites. In the region in which such an inversely segregated substance is present, a film is not normally formed during anodizing, and thus, defects are locally generated in the anodized layer. Such defects of the anodized layer are critical factors degrading the quality of the exterior material for smart devices, and therefore the generation of such an inversely segregated substance should be suppressed.

According to the inventive concept of the present disclosure, the abovementioned inversely segregated substance is not formed on the surface of the aluminum alloy exterior material by controlling the solidification speed to be fast in the strip casting process, and accordingly, the generation of defects in the anodized layer due to an inversely segregated substance may be suppressed.

In summary, the aluminum alloy exterior material according to the inventive concept of the present disclosure has a 6000 or 7000 series composition range corresponding to a wrought material, but has a cast grain structure as being manufactured by strip casting, and has a structure having an anodized layer on the surface thereof.

Hereinafter, an experimental example will be described in detail to help understand the present disclosure. The following experimental example is provided to help understand the present disclosure, and is not limited to the following experimental example.

An aluminum alloy cast sheet was manufactured by using a twin roll casting apparatus illustrated in FIG. 16. At this point, the composition of the aluminum alloy and the material used for the twin roll were changed as a manufacturing condition. A copper twin roll and a steel twin roll are used for the twin roll corresponding to a rotating mold. After injecting a molten aluminum alloy having various compositions into a tundish, the molten aluminum alloy was moved to the gap between the rotated twin rolls. The molten aluminum alloy was quickly solidified by coming into contact with the twin roll cooled by cooling water, and was then manufactured as a plate-like cast material while passing through the gap between the twin rolls.

Experimental Example 1: 7000 Series Aluminum Alloy Cast Sheet

Table 1 illustrates the composition of the 7000 series aluminum alloy used in experimental example 1.

TABLE 1

| | Al | Zn | Mg | Cu | Fe | Cr | Si | Mn | Ti |
|---|---|---|---|---|---|---|---|---|---|
| Example 1 | Bal. | 5.18 | 2.27 | 1.49 | 0.23 | 0.22 | 0.11 | 0.045 | 0.05 |
| Example 2 | Bal. | 5.90 | 2.40 | 1.89 | 0.17 | 0.20 | 0.14 | 0.96 | 0.04 |
| Example 3 | Bal. | 5.90 | 2.73 | 1.96 | 0.14 | 0.22 | 0.029 | 0.086 | 0.026 |
| Example 4 | Bal. | 7.79 | 2.64 | 0.01 | 0.20 | 0.21 | 0.22 | 0.09 | 0.030 |

TABLE 1-continued

| | Al | Zn | Mg | Cu | Fe | Cr | Si | Mn | Ti |
|---|---|---|---|---|---|---|---|---|---|
| Example 5 | Bal. | 7.73 | 2.81 | 1.02 | 0.21 | 0.24 | 0.027 | 0.088 | 0.027 |
| Example 6 | Bal. | 7.98 | 2.68 | 2.00 | 0.19 | 0.23 | 0.030 | 0.089 | 0.030 |
| Example 7 | Bal. | 9.75 | 2.74 | 1.85 | 0.21 | 0.24 | 0.028 | 0.088 | 0.028 |
| Comparative example 1 | Bal. | 5.0 | 1.31 | 0.004 | 0.1 | 0.10 | 0.2 | 0.28 | 0.02 |

In Table 1, examples are for aluminum alloy cast sheets manufactured by using a copper twin roll, and comparative example 1 is for an aluminum alloy extrusion sheet formed by using an extrusion process.

Figure 4:
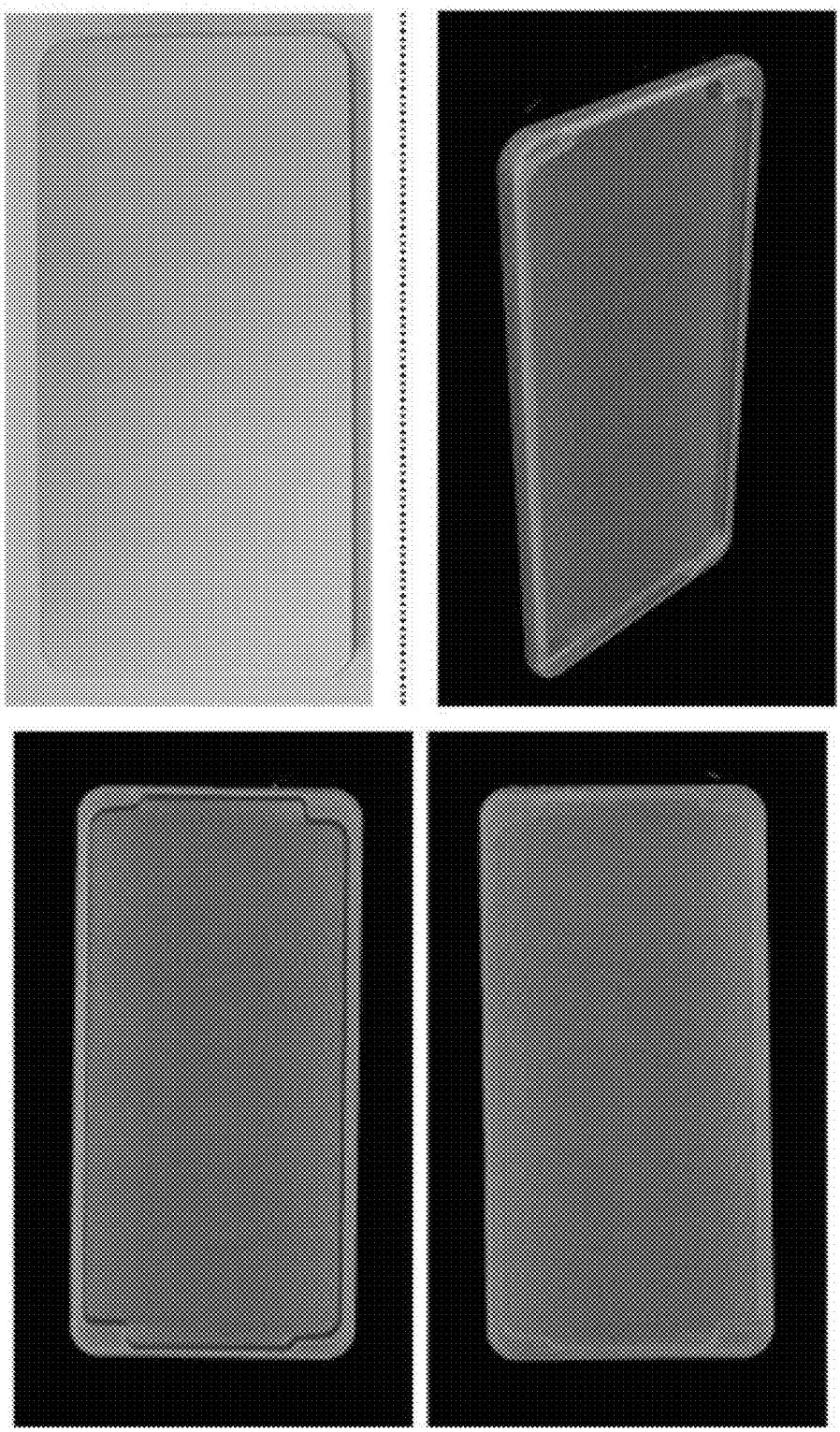
FIG. 4 illustrates results of three-dimensional computer tomography showing an aluminum alloy exterior material formed by using a method for manufacturing the aluminum alloy exterior material for smart devices in accordance with an embodiment.

FIG. 4 is a result of 3D CT imaging of the sheet which is obtained by CNC processing of the sheet corresponding to example 1 of experimental example 1 into a smartphone exterior material.

Referring to FIG. 4, it may be seen that the CNC processed exterior material has no structural defects such as internal pores, cracks, or the like observed therein and was processed in a favorable state.

Figure 5:
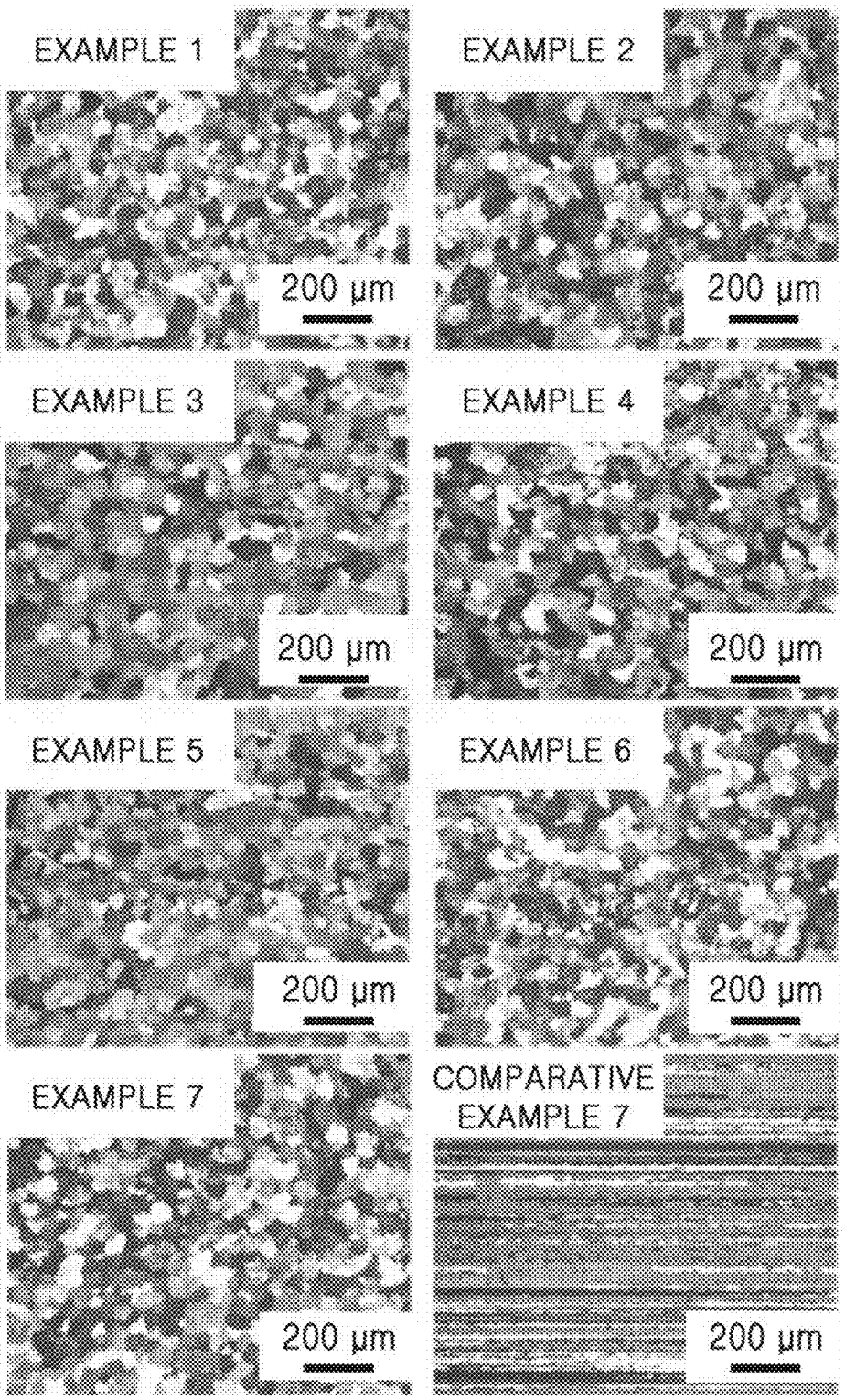
FIG. 5 illustrates optical microscope photographs showing microstructures after performing heat treatment on an aluminum alloy cast sheet in accordance with experimental example 1.

FIG. 5 illustrates optical microscope photographs showing microstructures after performing T6 heat treatment on an aluminum alloy cast sheet in accordance with experimental example 1.

Referring to FIG. 5, it may be seen that the aluminum alloy extruded sheet of comparative example 1 has a microstructure elongated by extrusion, and a large aspect ratio. Conversely, the aluminum alloy cast sheets of the examples have, as cast structures, microstructures composed of equiaxed cast grains.

Figure 6A:
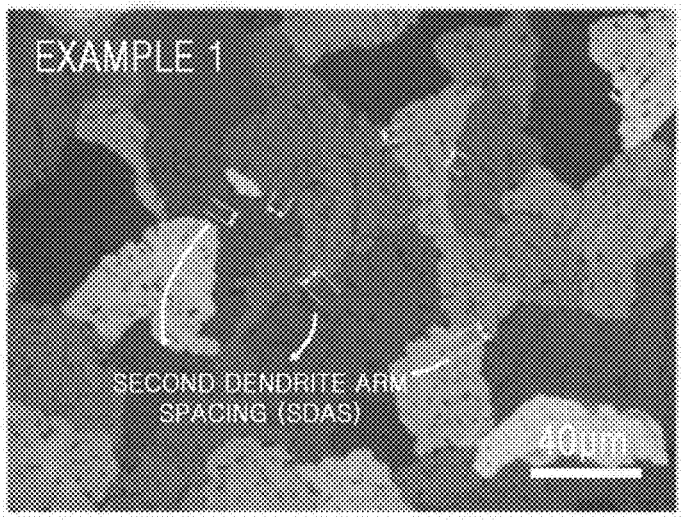
FIGS. 6A to 6C show the results of observing microstructures of aluminum alloy cast sheets in accordance with experimental examples of the present disclosure.
Figure 6B:
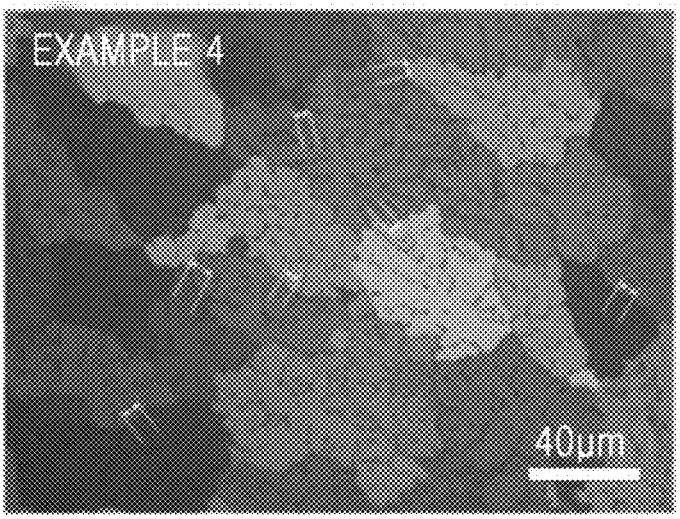

FIGS. 6A and 6B illustrate results of expanding the cast grains of examples 1 and 4. Referring to FIGS. 6A and 6B, it may be confirmed that dendrite structures formed inside the cast grains during a casting process in each example may be observed. The observed secondary dendrite arm spacing (SDAS) of the dendrites is in the range of about 2 μm to about 20 μm.

Figure 7:
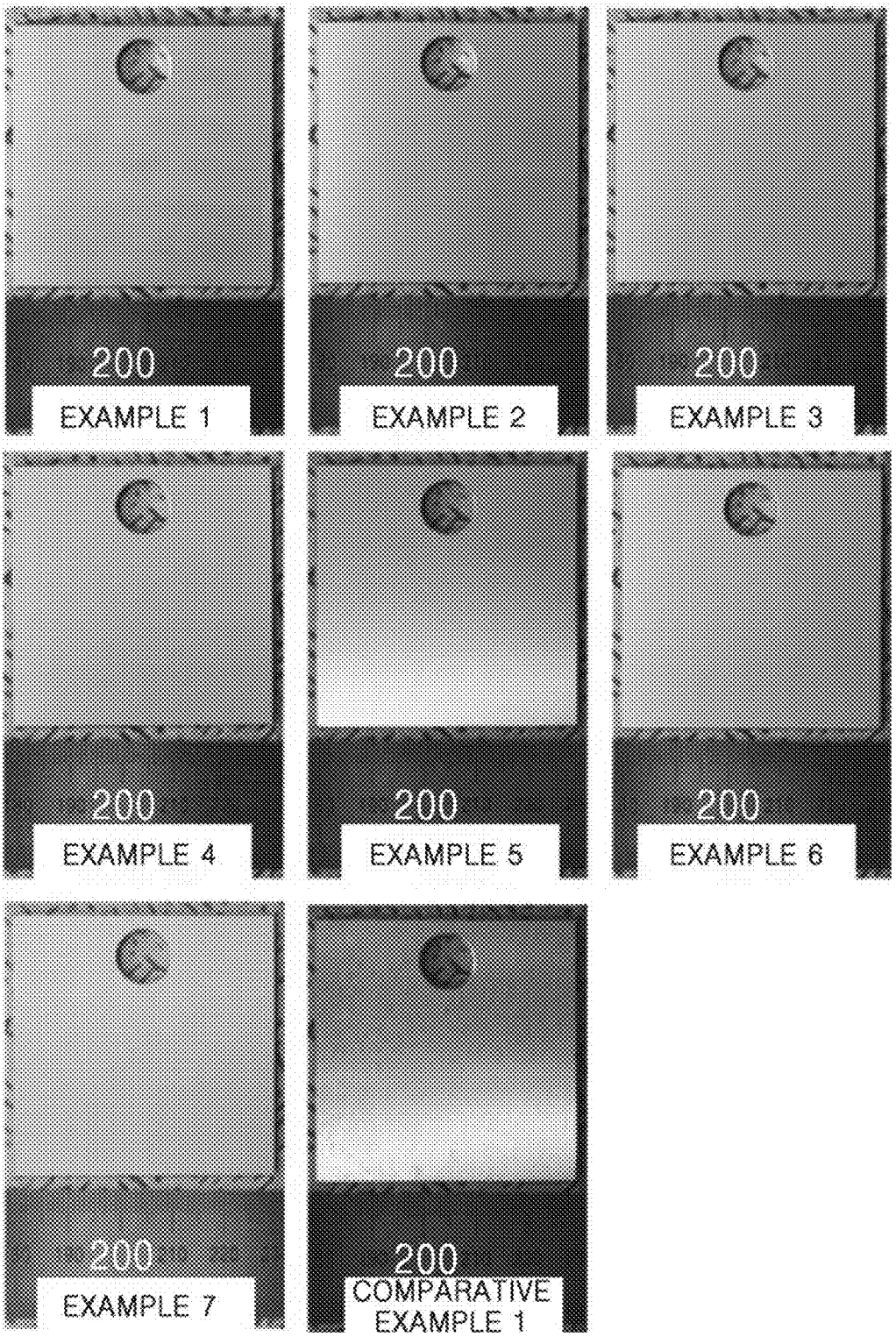
FIG. 7 illustrates exterior photographs showing surface states after performing anodizing treatment on the aluminum cast sheets in accordance with experimental example 1.

FIG. 7 illustrates exterior photographs showing surface states after performing anodizing on the aluminum cast sheets in accordance with experimental example 1. The anodizing treatment was performed in a silver color so as to easily observe defects such as casting patterns, segregation, or pores.

Referring to FIG. 7, defects such as casting patterns were not observed in all the examples, and very superior anodized surface quality. Meanwhile, in the case of comparative example 1, a partial strip pattern was observed on the surface, and this is a defect appearing when the crystal grains of the surface of an extrusion material during extrusion grow to be coarse. In case of an extrusion material, it may be seen that such defects are generated and thus, the quality of the anodized layer may be degraded.

Table 2 is the table illustrating mechanical characteristics of aluminum cast sheets in accordance with experimental example 1.

TABLE 2

| | Manufacturing process unique point | Yield strength (MPa) | Tensile strength (MPa) | Elongation (%) | Anodized surface characteristics |
|---|---|---|---|---|---|
| Example 1 | copper/copper | 451.4 | 479.6 | 1.82 | ○ |
| Example 2 | twin roll | 444.2 | 519.8 | 7.92 | ○ |
| Example 3 | casting | 474.6 | 517.6 | 3.68 | ○ |

TABLE 2-continued

| | Manufacturing process unique point | Yield strength (MPa) | Tensile strength (MPa) | Elongation (%) | Anodized surface characteristics |
|---|---|---|---|---|---|
| Example 4 | | 525.0 | 535.2 | 1.32 | ◎ |
| Example 5 | | 533.3 | 544.6 | 1.18 | ◎ |
| Example 6 | | 525.0 | 560.2 | 2.62 | ○ |
| Example 7 | | 520.1 | 534.7 | 1.24 | ◎ |
| Comparative example 1 | Extrusion | 435.0 | 471.6 | 12.8 | ○ |

Tensile test was performed five times for each example and average values are shown.
The anodizing treatment was performed once for each example.
Anodized surface characteristics:
◎—very excellent,
○—excellent,
Δ—normal,
X—bad Referring to Table 2, yield strengths and tensile strengths were exhibited to be larger in the examples than in comparative example 1, and the elongation was remarkably reduced. The anodized surface characteristics were exhibited to be excellent in the comparative example and the examples in the approximately the same level.

Figure 8:
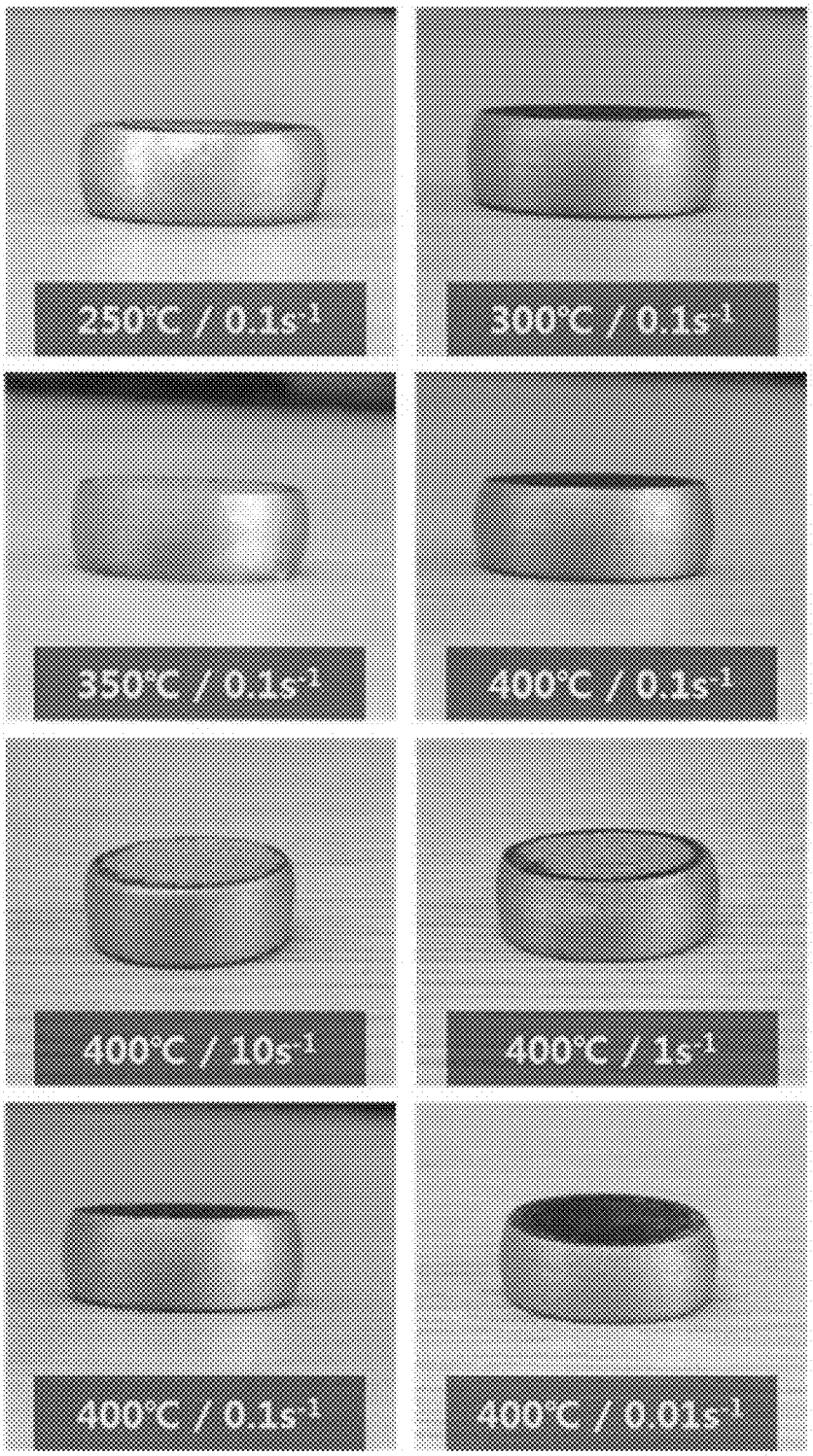
FIG. 8 illustrates exterior photographs showing a surface state after performing hot working on the aluminum alloy cast sheet in accordance with experimental example 1.

FIG. 8 illustrates exterior photographs showing a state of external appearance after performing hot working on the aluminum alloy cast sheets in accordance with experimental example 1.

Referring to FIG. 8, hot workability was evaluated before cutting an aluminum alloy cast sheet obtained by casting the aluminum alloy corresponding to example 1 of experimental example 1. The hot workability was evaluated by a hot compression test at various deformation speeds of 0.01/sec to 10/sec at various temperatures in the range of 250° C. to 400° C. Although compression was performed up to about 60% with respect to heights, cracks did not occur in external appearances in all cases.

Figure 9:
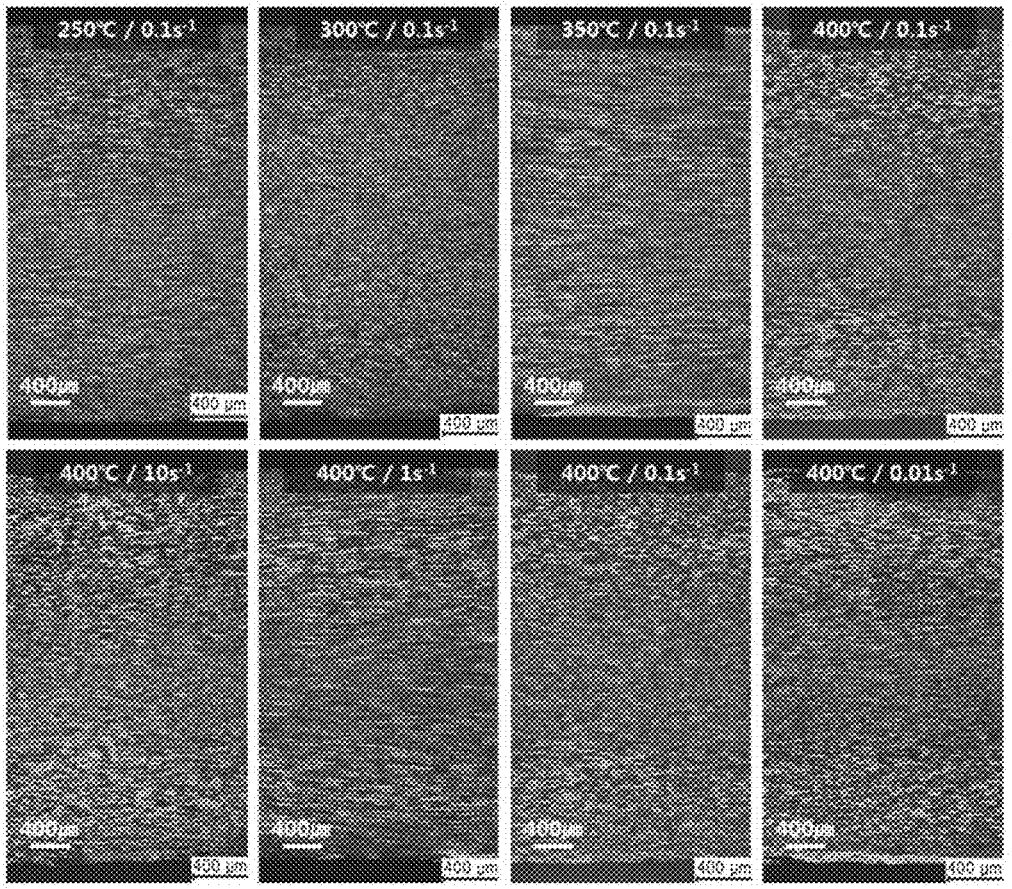
FIG. 9 illustrates optical photographs showing microstructures after performing hot working on an aluminum alloy cast sheet in accordance with experimental example 1.

FIG. 9 illustrates optical microscope photographs showing microstructures after performing a hot compression test on aluminum alloy cast sheets in accordance with experimental example 1.

Referring to FIG. 9, similarly to external appearance results of FIG. 8, defects such as cracks were not found even in internal microstructures. However, since the hot compression was performed, crystal grains were arranged in a somewhat elongated shape. However, when compared with the microstructure of the aluminum alloy extruded sheet of comparative example 1 of FIG. 5, it may be confirmed that the aspect ratio is very small. The reason why a defect does not occur as such after performing the hot working is due to the distribution of fine cast grains and second phases of the aluminum alloy cast sheet. That is, when the sizes of cast grains are fine, applied deformation amounts are dispersed to multiple cast grains and may delay the generation of defects such as cracks. In addition, it is interpreted that when coarse second phases are present, the second phases are firstly fractured due to brittleness, and cracks thereby generated may be propagated, and in the case of the aluminum cast sheets of the current experimental example, coarse second phases that cause brittleness are not generated, and thus, cracks are not generated.

Experimental Example 2: 6000 Series Aluminum Alloy Cast Sheet

Table 3 illustrates the composition of the 6000 series aluminum alloy used in experimental example 2.

TABLE 3

| | Al | Si | Mg | Cu | Fe | Mn | Ti | Cr | Zn |
|---|---|---|---|---|---|---|---|---|---|
| Example 8 | Bal. | 1.21 | 0.58 | 0.01 | 0.08 | 0.06 | 0.02 | — | — |
| Example 9 | Bal. | 1.18 | 0.62 | 0.09 | 0.08 | 0.06 | 0.02 | — | — |
| Example 10 | Bal. | 1.25 | 0.64 | 0.23 | 0.07 | 0.06 | 0.02 | — | — |
| Example 11 | Bal. | 1.01 | 0.55 | 0.01 | 0.18 | 0.01 | 0.02 | 0.01 | 0.006 |
| Example 12 | Bal. | 1.32 | 0.48 | 0.11 | 0.13 | 0.08 | 0.03 | 0.02 | — |
| Comparative example 2 | Bal. | 0.70 | 0.85 | 0.73 | 0.10 | 0.30 | 0.02 | 0.02 | — |

In Table 3, examples 8 to 10 are for aluminum alloy cast sheets manufactured by using a copper twin roll, examples 11 and 12 are for aluminum alloy cast sheets manufactured by using a steel twin roll, and comparative example 2 is for an aluminum alloy cast sheet formed by using an extrusion process.

Figure 10:
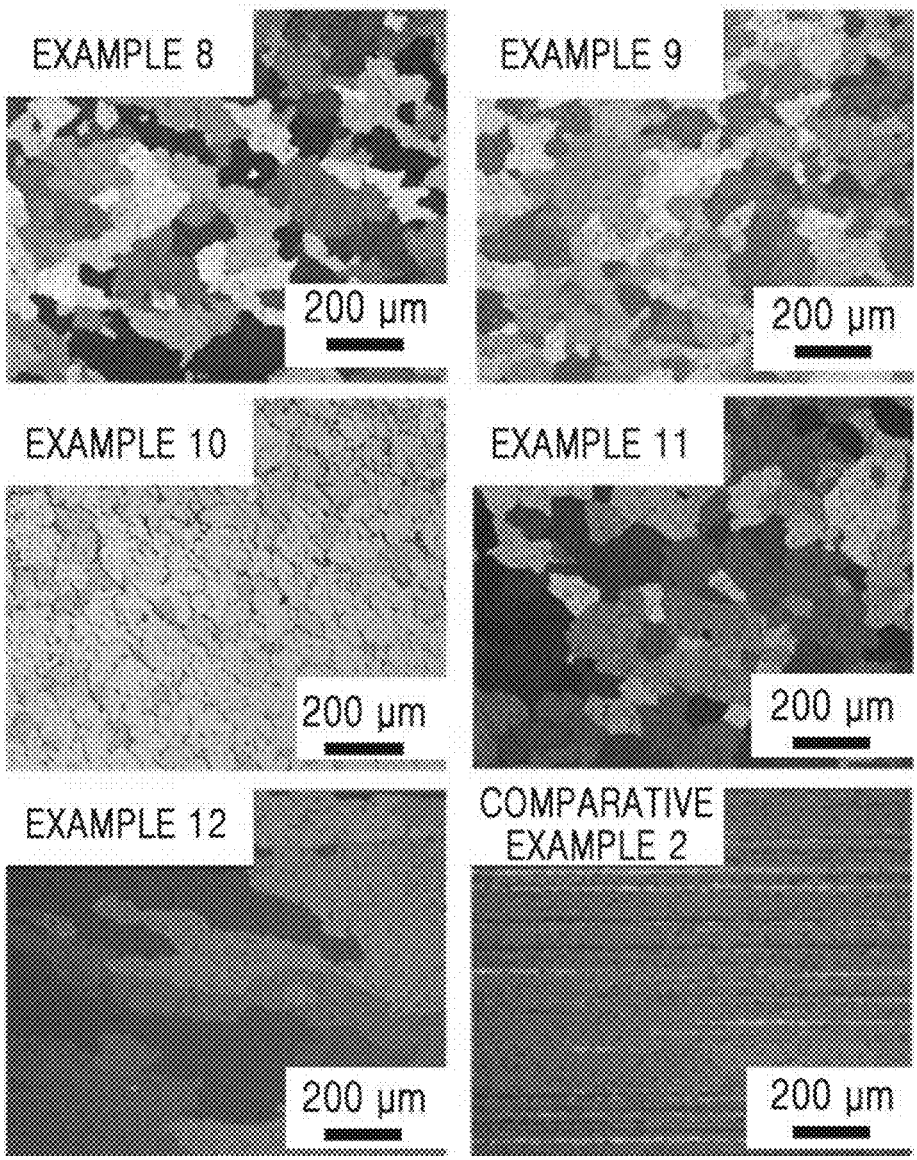
FIG. 10 illustrates optical photographs showing microstructures after performing heat treatment on an aluminum alloy cast sheet in accordance with experimental example 2.

FIG. 10 illustrates optical microscope photographs showing microstructures after performing T6 heat treatment on aluminum alloy cast sheets in accordance with experimental example 2. Referring to FIG. 10, it may be seen that the aluminum alloy extruded sheet of comparative example 2 has microstructures elongated by extrusion and a large aspect ratio. Conversely, the aluminum alloy cast plated materials of the examples are cast structures and have microstructures composed of equiaxed crystal cast grains.

Figure 6C:
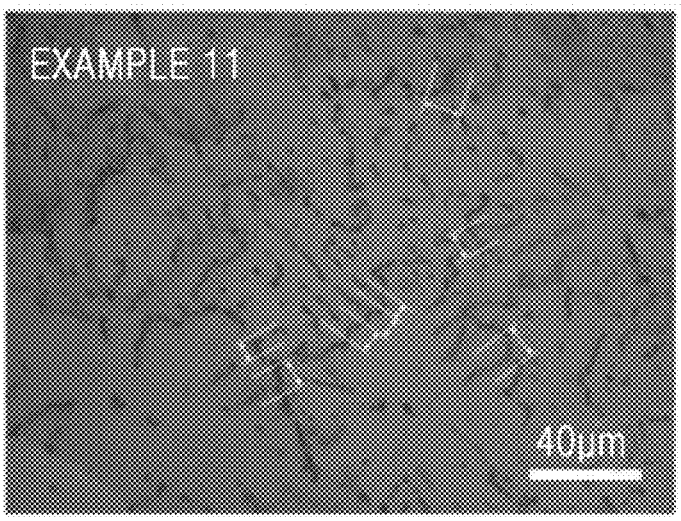

FIG. 6C illustrates a result of expanding the cast grains of example 11, and it may be confirmed that when observing the result, dendrite structures each having an SDAS of less than about 20 μm were formed inside the cast grains.

As in examples 11 and 12, when manufactured by the steel twin roll, a structure having a partially elongated crystal grains on a surface portion may be formed.

Figure 11:
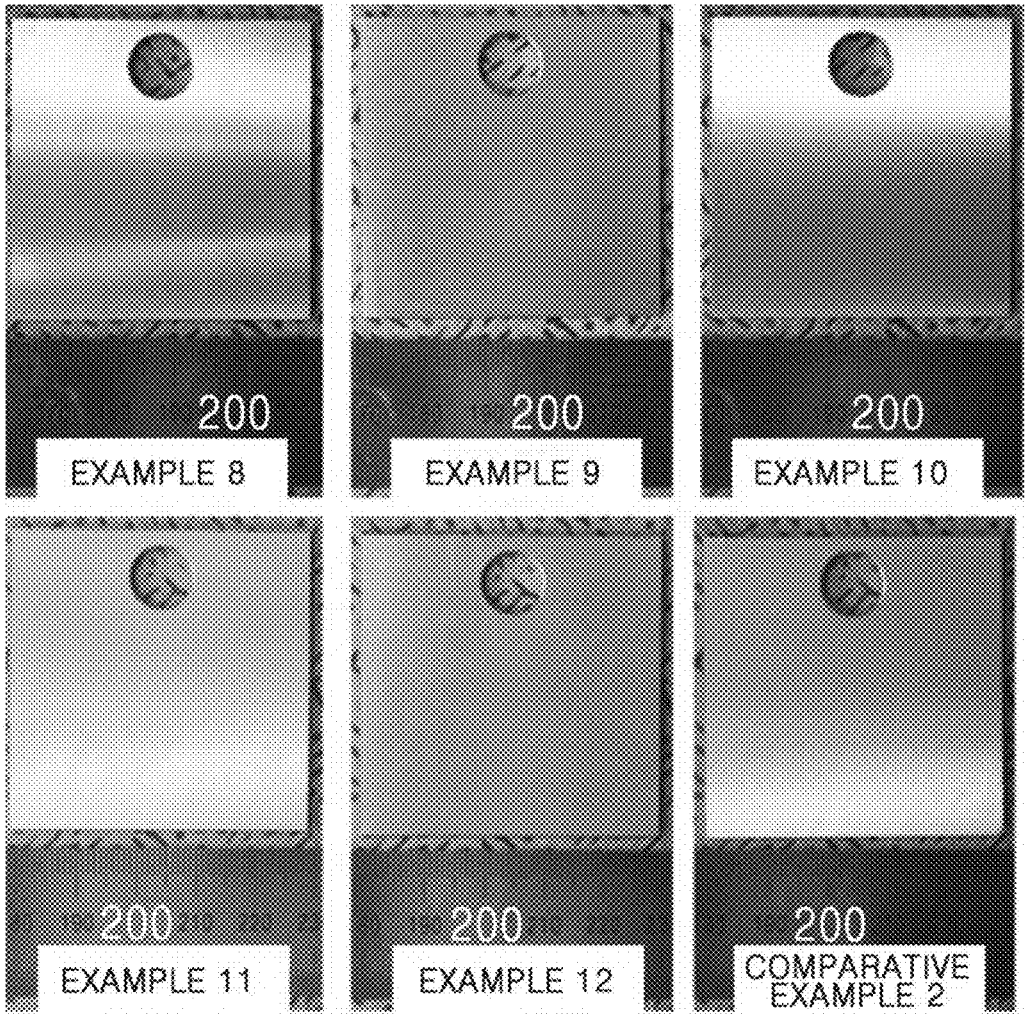
FIG. 11 illustrates exterior photographs illustrating a surface state after performing anodizing treatment on the aluminum cast sheet in accordance with experimental example 2.

FIG. 11 illustrates exterior photographs showing surface states after performing anodizing on the aluminum cast sheets in accordance with experimental example 2. The anodizing treatment was performed in a silver color so as to easily observe defects such as casting patterns, segregation, or pores.

Referring to FIG. 11, defects such as casting patterns were not observed in all the examples and comparative example. The anodized surface characteristics were exhibited to be excellent in the comparative examples and examples in the approximately the same level.

Table 4 is the table illustrating mechanical characteristics of an aluminum alloy cast sheet in accordance with experimental example 2.

TABLE 4

| | Manufacturing process unique point | Yield strength (MPa) | Tensile strength (MPa) | Elongation (%) | Anodized surface characteristics |
|---|---|---|---|---|---|
| Example 8 | copper/copper | 305.1 | 330.6 | 7.14 | ◎ |
| Example 9 | twin roll | 330.4 | 330.6 | 7.98 | ◎ |

TABLE 4-continued

| | Manufacturing process unique point | Yield strength (MPa) | Tensile strength (MPa) | Elongation (%) | Anodized surface characteristics |
|---|---|---|---|---|---|
| Example 10 | casting | 320.0 | 360.8 | 14.61 | ◎ |
| Example 11 | steel/steel | 289.8 | 322.6 | 9.38 | ○ |

TABLE 4-continued

| | Manufacturing process unique point | Yield strength (MPa) | Tensile strength (MPa) | Elongation (%) | Anodized surface characteristics |
|---|---|---|---|---|---|
| Example 12 | twin roll casting | 260.2 | 294.0 | 12.0 | ○ |
| Comparative example 2 | Extrusion | 319.0 | 373.1 | 13.6 | ○ |

Tensile test was performed five times and average values are shown.
The anodizing treatment was performed once for each example,
Anodized surface characteristics:
◎—very excellent,
○—excellent,
Δ—normal,
X—bad Referring to Table 4, the specimens of examples 8 to 12 exhibit, according to the compositions thereof, yield strengths of 260 MPa to 330 MPa and tensile strengths of about 300 MPa to 360 MPa. Accordingly, it may be confirmed that the sheets according to the examples of the present disclosure have strength characteristics sufficiently usable as an exterior material for smart devices. Meanwhile, it may be confirmed that the anodized surface characteristics exhibit the same level of characteristics when compared with comparative example 2 which is an extruded material.

Analysis of Influence on Thermal Conductivity of Rotating Mold

Hereinafter, influence on an aluminum alloy cast sheet according to the thermal conductivity of a rotating mold will be described in more detail.

Figure 12A:
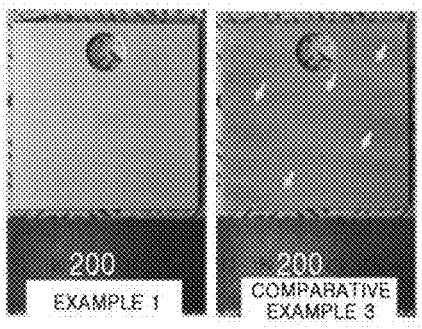
FIGS. 12A to 12C show the results of comparing differences between anodizing characteristics, external appearances, microstructures of aluminum alloy cast sheets in accordance with example 1 and comparative example 3.
Figure 12B:
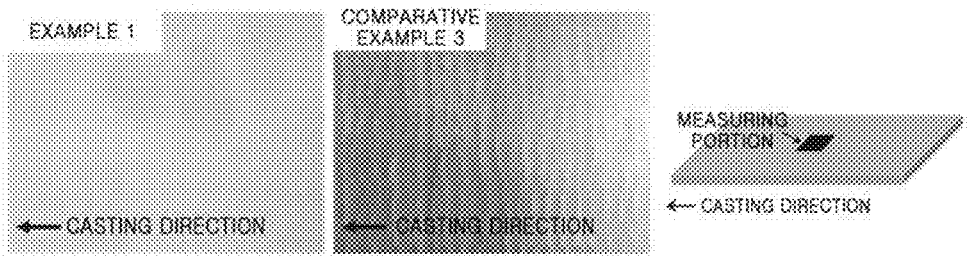
Figure 12C:
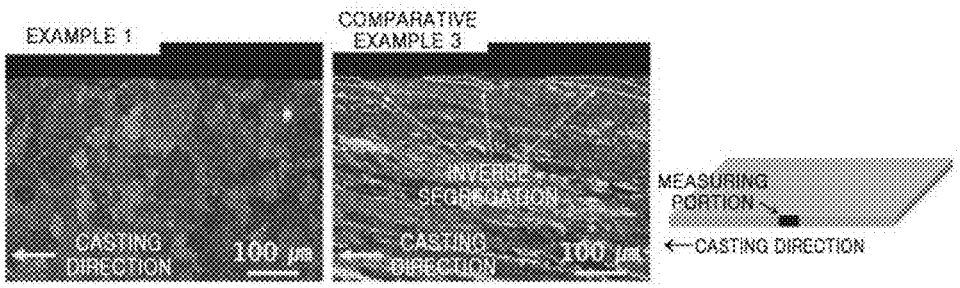

FIGS. 12A to 12C show the results of comparing differences between anodizing characteristics, external appearances, microstructures of an aluminum alloy cast sheet in accordance with example 1 and comparative example 3. In FIGS. 12A to 12C, example 1 and comparative example 3 have the same alloy composition (A7075), example 1 is manufactured by using a copper twin roll, and comparative example 3 is manufactured by using a steel twin roll. It is known that the copper twin roll has thermal conductivity in the range of 200 W/m·K to 500 W/m·K. and a steel twin roll has thermal conductivity in the range of 20 W/m·K to 50 W/m·K.

FIGS. 12A and 12B illustrate results of observing surfaces after anodizing of example 1 and comparative example 3.

Example 1 has a smooth and excellent anodized surface. Conversely, it may be confirmed that the quality of the anodized layer of comparative example 3 is degraded in colors or homogeneity compared to those in example 1. In particular, noticeable casting patterns are exhibited as indicated by the white arrows, and the casting patterns exhibit shapes vertically extending in the casting direction.

FIG. 12C illustrates optical microscope photographs of cross-sectional surfaces of an aluminum alloy cast sheet. Referring to FIG. 12C, example 1 exhibits a cast structure having equiaxed cast grains. Conversely, comparative example 3 has a microstructure elongated in the casting direction and inversely segregated substances are formed on a surface. Accordingly, it may be seen that the quality of the anodized layers is degraded due to the inversely segregated substances formed on the surface.

Figure 13:
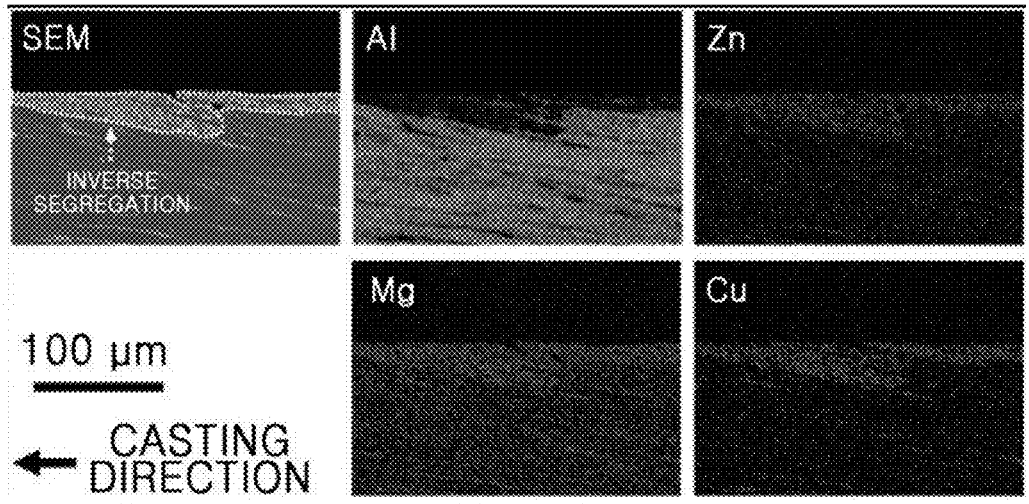
FIG. 13 illustrates SEM-EDS photographs for analyzing inversely segregated substances of the aluminum alloy cast sheet in accordance with comparative example 3.

FIG. 13 illustrates SEM-EDS photographs for analyzing inversely segregated substances of the aluminum alloy cast sheet in accordance with comparative example 3.

Referring to FIG. 13, it may be seen that the inversely segregated substances generated in the aluminum alloy cast sheet according to comparative example 3 formed by using a steel twin roll includes more contents of zinc (Zn), magnesium (Mg), and copper (Cu) than other regions. Since comparative example 3 includes silicon (Si) of a low level of 0.11 wt %, when the content of silicon is large, it is expected that the content of silicon increases in the inversely segregated substances.

Figure 14:
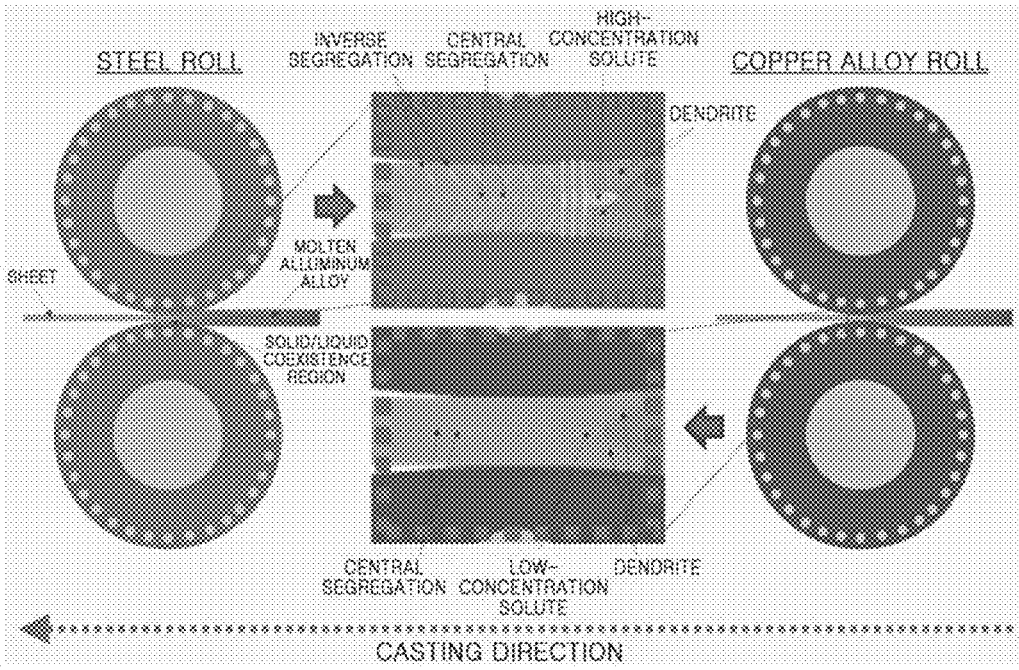
FIG. 14 is a schematic view illustrating a solidifying mechanism according to thermal conductivity of a mold rotating with respect to the aluminum alloy cast sheets in accordance with example 1 and comparative example 3.

FIG. 14 is a schematic view illustrating a solidifying mechanism according to the thermal conductivity of a mold rotating with respect to the aluminum alloy cast sheets in accordance with example 1 and comparative example 3.

Referring to FIG. 14, there is illustrated a formation process of a solidified structure when using a copper twin roll and a steel twin roll and a formation mechanism of inversely segregated substances. When an alloy is solidified, solute elements are accumulated on the solidification tip due to a difference in solid solubility between a solid phase and a liquid phase.

The steel twin roll has a low cooling speed due to low thermal conductivity, and therefore has a low solidifying speed of molten metal, and high-concentration solute elements formed during solidification move to the surface of the sheet due to a pressure applied on the high-concentration solute elements through a path, which is a non-solidified region between dendrites. Thus, inversely segregated substances are formed on the surface of the sheet, and this acts as a cause for occurrence of defects after anodizing treatment.

Since a copper twin roll or a copper alloy twin roll have a higher cooling speed than a steel twin roll, the solidification speed of the alloy is high, the amount of solute elements inside the dendrites increases, and the amount of solutes accumulated in the solidification tips of the dendrites relatively decreases. In addition, the dendrites sufficiently grow and a path is blocked through which the solute elements accumulated inside may move to the surface of the sheet. Thus, formation of inversely segregated substances may be suppressed on the surface of the sheet, and therefore, excellent anodization quality is exhibited after anodizing.

As such even in case of the same composition as in example 1 and comparative example 3, the cooling speed affects the segregation formation behavior on the surface portion, and this affects the anodizing characteristics, and therefore it is analyzed that the composition and the cooling speed should be considered together.

The cooling speed is affected by various factors such as the material of the rotating mold, the size of the rotating mold, the set-back distance, the number and size of cooling water holes, distances from the surface, or the amount of cooling water, and therefore the factors are unified into a single factor of the "thermal conductivity of the rotating mold". In addition, since the "thermal conductivity of the rotating mold" also varies when the temperature of the rotating mold increases or when cooling water is injected, and the thermal conductivity is expressed by a range.

The thermal conductivity of the rotating mold may be obtained by the method described below. Firstly, since a 6000 or 7000 series aluminum alloy includes Zn, Mg, Cu, and Si as main elements, the sum of weight fraction of the four elements is set as the numerator. In addition, it is known that a steel material mold has thermal conductivity in the range of 20 W/m·K to 50 W/m·K, and a copper material mold has thermal conductivity in the range of 200 W/m·K to 500 W/m·K, and this is set as the denominator. Here, the thermal conductivity varies according to temperatures or cooling conditions, and thus is set by a range, and the thermal conductivity refers to the thermal conductivity at the room temperature.

Thus, the value of "X" was calculated by Equation 1 below.

$$X=(W_{Zn}+W_{Mg}+W_{Cu}+W_{Si})/\mathrm{TC} \quad \text{<Equation 1>}$$

Here, $W_{Zn}+W_{Mg}+W_{Cu}+W_{Si}$ is the total content (wt %) of the sum of the zinc (Zn), magnesium (Mg), copper (Cu) and silicon (Si), and TC is the thermal conductivity (W/m·K) of the rotating mold.

Table 5 is the table illustrating the value of X of the 7000 series aluminum alloy cast sheet of experimental example 1.

TABLE 5

| | | | | | | X value | |
|---|---|---|---|---|---|---|---|
| | Zn | Mg | Cu | Si | Total | Copper twin roll 200 W/m K | Copper twin roll 500 W/m K |
| Example 1 | 5.18 | 2.27 | 1.49 | 0.11 | 9.05 | 0.045 | 0.018 |
| Example 2 | 5.90 | 2.40 | 1.89 | 0.14 | 10.33 | 0.052 | 0.021 |
| Example 3 | 5.90 | 2.73 | 1.96 | 0.029 | 10.62 | 0.053 | 0.021 |
| Example 4 | 7.79 | 2.64 | 0.00 | 0.22 | 10.65 | 0.053 | 0.021 |
| Example 5 | 7.73 | 2.81 | 1.02 | 0.027 | 11.59 | 0.058 | 0.023 |
| Example 6 | 7.98 | 2.68 | 2.00 | 0.030 | 12.69 | 0.063 | 0.025 |
| Example 7 | 9.75 | 2.74 | 1.85 | 0.028 | 14.37 | 0.072 | 0.029 |

TABLE 5-continued

| | | | | | | Steel twin roll 20 W/m K | Steel twin roll 50 W/m K |
|---|---|---|---|---|---|---|---|
| Comparative example 3 | 5.84 | 2.78 | 1.98 | 0.04 | 10.64 | 0.532 | 0.213 |

Table 6 is the table illustrating the value of X of the 6000 series aluminum alloy cast sheet of experimental example 2.

TABLE 6

| | | | | | | X value | |
|---|---|---|---|---|---|---|---|
| | Zn | Mg | Cu | Si | Total | Copper twin roll 200 W/m K | Copper twin roll 500 W/m K |
| Example 8 | — | 0.58 | — | 1.21 | 1.79 | 0.009 | 0.004 |
| Example 9 | — | 0.62 | 0.09 | 1.18 | 1.89 | 0.009 | 0.005 |
| Example 10 | — | 0.64 | 0.23 | 1.25 | 2.12 | 0.011 | 0.004 |
| | | | | | | Steel twin roll 20 W/m K | Steel twin roll 50 W/m K |
| Example 11 | 0.006 | 0.551 | 0.002 | 1.011 | 1.57 | 0.079 | 0.031 |
| Example 12 | — | 0.48 | 0.11 | 1.32 | 1.91 | 0.096 | 0.038 |

Figure 15:
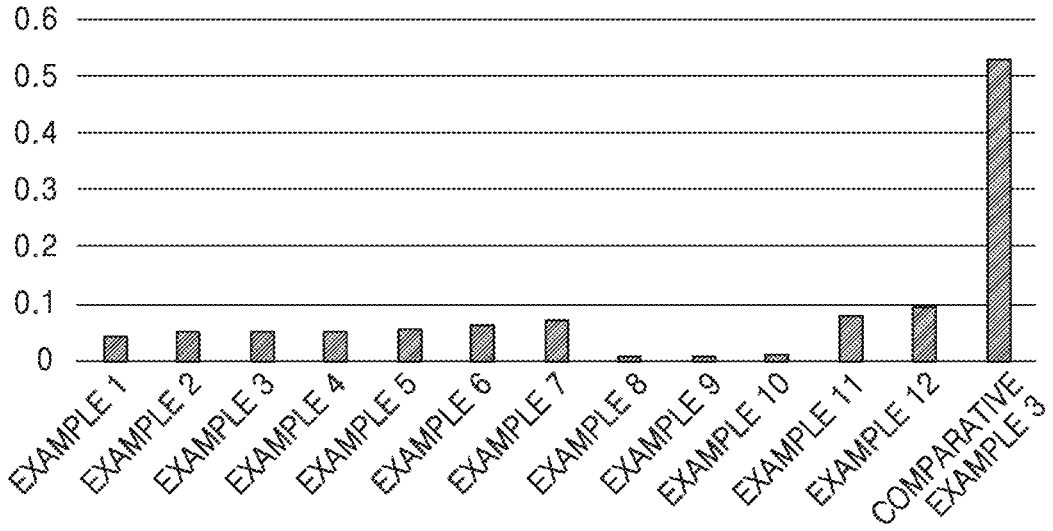
FIG. 15 is a graph illustrating a value of X shown in <Equation 1>.

FIG. 15 is a graph illustrating a maximum value of X in each example. The maximum value of X is the value calculated by setting the thermal conductivity of the copper twin roll and the steel twin roll to 200 W/m·K and 20 W/m·K, respectively.

Referring to Tables 5 and 6, in all examples, the value of X is smaller than 0.15, favorably smaller than 0.1, and accordingly, as described above, anodizing characteristics are excellent and inverse segregation are not generated. Conversely, as illustrated in Table 5, in the 7000 series aluminum alloy cast sheet having relatively high solute element content, the value of X is large as much as 0.213 to 0.532 which is greater than 0.15, in case of comparative example 3 in which a steel twin roll having a low cooling speed is used. Thus, the abovementioned degraded anodizing characteristics and inverse segregation occur. As illustrated in Table 6, in case of an 6000 aluminum alloy, since the solute element content is relatively low, even when using the steel roll as in examples 11 and 12, the value of X is exhibited to be lower than 0.15, and thus, excellent anodizing characteristics is exhibited and inverse segregation does not occur.

When the value of X satisfies the range of greater than 0 to equal to or smaller than 0.15 wt %/(W/m·K), a sufficient cooling speed may be obtained, inverse segregation on the surface part is decreased, and anodizing characteristics may be made excellent. Inverse segregation may occur out of the above numerical range, and this may cause degradation in surface anodizing characteristics.

According to the inventive concept of the present disclosure, in a manufacturing process of an aluminum alloy exterior material for smart devices manufactured by conventional casting, homogenization treatment, extrusion, heat treatment, cutting, anodizing processes, several steps from the casting process to the extrusion process are replaced by a strip casting process, whereby process steps may be simplified and manufacturing costs may be remarkably reduced. The aluminum alloy exterior material for smart devices which is manufactured by the manufacturing method may have superior mechanical characteristics and superior anodizing surface characteristics.

The abovementioned effects of the present disclosure are exemplarily described, and the scope of the present disclosure is not limited by the effects.

The inventive concept of the present invention described so far is not limited to the abovementioned embodiments and the accompanying drawings, it would be obvious to those skilled in the art that various replacements, modifications, and changes can be made therein without departing from the spirit and scope of the following claims.

What is claimed is:

1. A method for manufacturing an aluminum alloy exterior material for smart devices, the method comprising:

preparing a molten aluminum alloy;

casting the molten aluminum alloy into a sheet shape using a rotating mold to form an aluminum alloy cast sheet; and anodizing the aluminum alloy cast sheet, wherein in the forming of an aluminum alloy cast sheet, X in Equation 1 below has a value in a range of greater than 0 to equal to or less than 0.15, $$X=(W_{Zn}+W_{Mg}+W_{Cu}+W_{Si})/\mathrm{TC}(\text{wt }\%/(W/m\cdot K)) \quad \text{<Equation 1>}$$

where $W_{zn}$ is the content (wt %) of the zinc (Zn) in the aluminum alloy, $W_{Mg}$ is the content (wt %) of the magnesium (Mg) in the aluminum alloy, $W_{Cu}$ is the content (wt %) of the copper (Cu) in the aluminum alloy and $W_{Si}$ is the content (wt %) of the silicon (Si) in the aluminum alloy, and where $W_{Zn}+W_{Mg}+W_{Cu}+W_{Si}$ is the total content (wt %) of the zinc (Zn), magnesium (Mg), copper (Cu) and silicon (Si) in the aluminum alloy, and TC is the thermal conductivity (W/m K) of the rotating mold, wherein the aluminum alloy cast sheet comprises a 6000 series aluminum alloy or a 7000 series aluminum alloy, wherein the rotating mold comprises a copper twin roll, and wherein the copper twin roll has thermal conductivity in a range of 200 W/m·K to 500 W/m·K.

2. The method of claim 1, further comprising heat-treating the aluminum alloy cast sheet after performing forming of the aluminum alloy cast sheet.

3. The method of claim 2, wherein the heat-treating comprises performing a solution treatment for 30 minutes to 10 hours at a temperature of 420° C. to 570° C.

4. The method of claim 3, wherein the heat-treating further comprises, after performing the solution treatment, performing an aging treatment for 1 hour to 30 hours at a temperature of 100° C. to 250° C.

5. The method of claim 2, further comprising cutting the aluminum alloy cast sheet after performing the forming of the aluminum alloy cast sheet.

6. The method of claim 1, wherein the aluminum alloy cast sheet comprises:

zinc (Zn) in the range of 5 wt % to 10 wt %;

magnesium (Mg) in the range of 1 wt % to 4 wt %;

copper (Cu) in the range of greater than 0 wt % to 3 wt %;

silicon (Si) in the range of greater than 0 wt % to 0.5 wt %; and the remainder being aluminum and inevitable impurities.

7. The method of claim 1, wherein the aluminum alloy cast sheet comprises:

silicon (Si) in the range of greater than 0 wt % to 1.5 wt %;

magnesium (Mg) in the range of greater than 0 wt % to 1.2 wt %;

copper (Cu) in the range of greater than 0 wt % to 1 wt %;

zinc (Zn) in the range of greater than 0 wt % to 0.5 wt %; and the remainder being aluminum and inevitable impurities.

* * * * *